US010287787B2

(12) United States Patent
Kepper

(10) Patent No.: US 10,287,787 B2
(45) Date of Patent: May 14, 2019

(54) LOAD CONVEYANCE APPARATUS

(71) Applicant: Jimmie Kepper, Greenwell Springs, LA (US)

(72) Inventor: Jimmie Kepper, Greenwell Springs, LA (US)

( * ) Notice: Subject to any disclaimer, the term of this patent is extended or adjusted under 35 U.S.C. 154(b) by 0 days.

(21) Appl. No.: 15/927,767

(22) Filed: Mar. 21, 2018

(65) Prior Publication Data

US 2018/0274253 A1 Sep. 27, 2018

Related U.S. Application Data

(60) Provisional application No. 62/474,177, filed on Mar. 21, 2017.

(51) Int. Cl.
*E04G 5/06* (2006.01)
*E04G 23/02* (2006.01)

(52) U.S. Cl.
CPC ..... *E04G 23/0218* (2013.01)

(58) Field of Classification Search
CPC combination set(s) only.
See application file for complete search history.

(56) References Cited

U.S. PATENT DOCUMENTS 3,504,879 A * 4/1970 Strickland ..... E04G 17/16 248/296.1
3,843,084 A * 10/1974 Gregory ..... E04G 17/16 248/295.11
3,863,877 A * 2/1975 Gregory ..... E04G 17/16 248/295.11
3,900,179 A * 8/1975 Mocny ..... E04G 17/16 248/287.1
3,967,806 A * 7/1976 Strickland ..... E04G 17/16 248/287.1
4,450,121 A * 5/1984 Bequette ..... E04G 3/20 264/31
5,056,750 A * 10/1991 Ellithorpe ..... E04B 1/2612 248/354.3
7,475,856 B2 * 1/2009 Riblet ..... A47B 57/567 182/136

* cited by examiner

*Primary Examiner* — Brian E Glessner
*Assistant Examiner* — Daniel J Kenny

(57) ABSTRACT

A load conveyance apparatus that is adjustable allows full or partial load conveyance from an original failing load-bearing source to the load conveyance apparatus. The load conveyance apparatus includes a first side plate, a second side plate, a front load shelf, a load-bearing plate, and at least one load-applying mechanism. The first side plate and the second side plate provide stability between the load conveyance apparatus and a failing load-bearing source. The front load shelf is used to support the at least one load-applying mechanism. The load-bearing plate makes direct contact with the failing load-bearing source and is conveyed the load of the failing load-bearing source. The at least one load-applying mechanism provides an upward load to the failing load-bearing source and is removed after the load is applied.

18 Claims, 6 Drawing Sheets

LOAD CONVEYANCE APPARATUS

The current application claims a priority to the U.S. Provisional Patent application Ser. No. 62/474,177 filed on Mar. 21, 2017.

FIELD OF THE INVENTION

The present invention relates generally to load conveyance devices. More specifically, the present invention is a load conveyance apparatus that is adjustable and allows full or partial load conveyance from a failing load-bearing source to the present invention.

BACKGROUND OF THE INVENTION

Precast concrete structures such as parking garages and bridges rely on concrete steps, pockets or haunches on concrete walls, columns, and beams for support of subsequent concrete beams, Tee's and Double Tee sections spanning between said walls, columns, or beams. These beam-column connections are required to allow for lateral movement due to thermal expansion and contraction. The process of this expansion and contraction movement over time creates a crumbling in the step or haunch which will eventually lead to failure of the entire connection.

The present invention seeks to provide a solution to this problem(s) by a manufactured metal apparatus that incorporates additional support to the column, while simultaneously providing new and additional support to the attaching beam and removing the load from the failing haunch or pocket.

The present invention is constructed of metal plate and extrusions that are engineered per the required loading. The present invention consists of two side plates that mount to the sides or face of the existing column which are parallel to the beam via embedded anchors, a back plate when required, a front load shelf and an adjustable bearing plate.

Preferably, the adjustable load-bearing plate will carry a low friction bearing pad or a linear roller bearing assembly to enable free movement, whether it be expansion, contraction or seismic. Many types of low friction devices can be incorporated here.

Preferably, with the device fully attached around all four sides or face of the column or anchored into the surrounding solid structure, the additional metal material acts as a brace to the column or other support structure and provides a method of applying a load, via a load cell, hydraulic jack or other similar load-applying device mounted between the front load shelf and the adjustable load bearing plate, to the beam straight from the column. In a precast structure, such as a parking garage, by not applying a load to the precast floor system, there is a tremendous economic gain in time and utilization of the parking area. Once the load is applied to the beam, the load is removed from the failing step or haunch. The bearing plate adjustments are tightened in place and the load-applying device can be removed. The load has then been conveyed fully or partially to the bearing plate of the device.

Additionally, if so desired, during apparatus design, the location of the bearing plate can allow for placement of a load-applying device behind it to remove the load from the bearing plate and provide maintenance to, or change out, the low friction device.

DETAIL DESCRIPTIONS OF THE INVENTION

Figure 1:
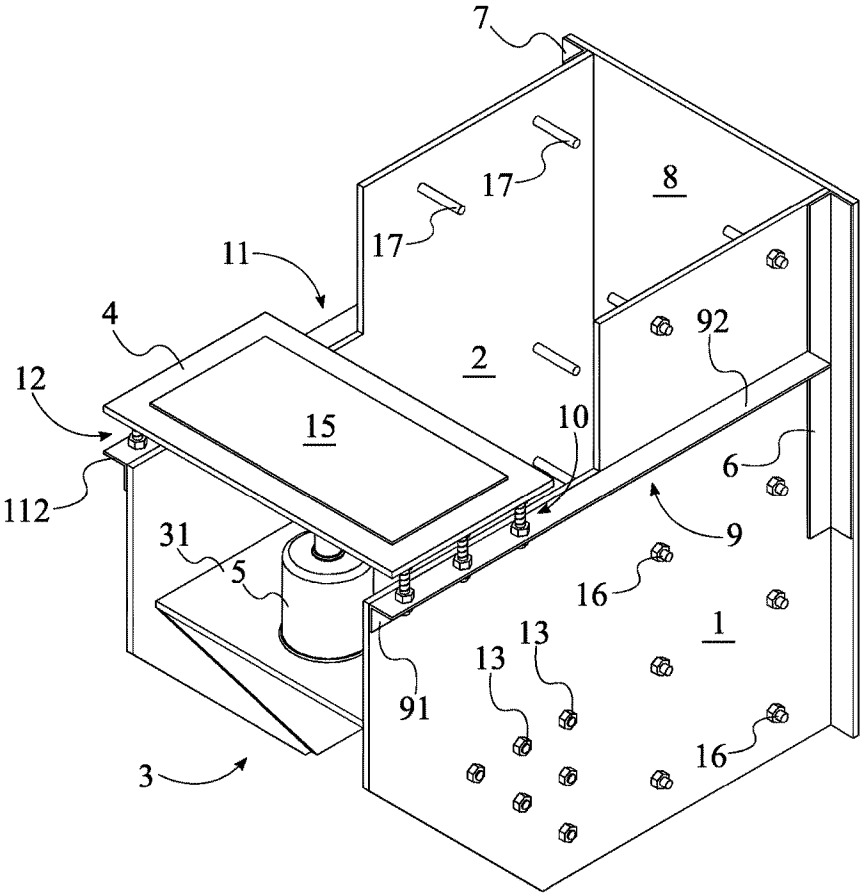
FIG. 1 is a front perspective view of the present invention.

All illustrations of the drawings are for the purpose of describing selected versions of the present invention and are not intended to limit the scope of the present invention.

In reference to FIGS. 1 through 6, the present invention is a load conveyance apparatus that is adjustable and allows full or partial load conveyance from a failing load-bearing source to the present invention. The present invention comprises a first side plate 1, a second side plate 2, a front load shelf 3, a load-bearing plate 4, and at least one load-applying mechanism 5. The first side plate 1 and the second side plate 2 provide stability between the present invention and the failing load-bearing source. The front load shelf 3 is used to support the at least one load-applying mechanism 5. The load-bearing plate 4 allows the load from the original failing load-bearing source to be transferred to the present invention. The at least one load-applying mechanism 5 allows the present invention to apply an upward load to the failing load-bearing source and can be removed after the upward load is applied.

Figure 6:
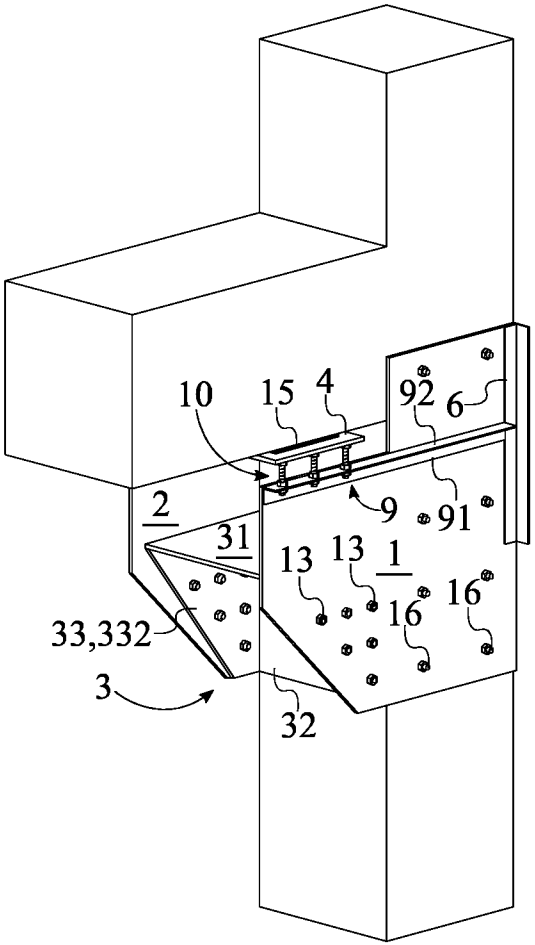
FIG. 6 is a front perspective view of the present invention mounted to a failing load-bearing source.

The general configuration of the aforementioned components allows the present invention to effectively and efficiently convey a load from a failing load-bearing source. With reference to FIG. 1, the first side plate 1 and the second side plate 2 are positioned parallel and offset to each other in order to properly stabilize the present invention with the failing load-bearing source. The front load shelf 3 is mounted in between the first side plate 1 and the second side plate 2 in order to be positioned offset from failing load bearing source. The load-bearing plate 4 is mounted in between the first side plate 1 and the second side plate 2 in order to be adjacent to the failing load-bearing source. The load-bearing plate 4 and the front load shelf 3 are positioned offset from each other which allows enough space to insert the at least one load-applying mechanism 5. The at least one load-applying mechanism 5 may be any mechanism able to apply a load such as, but not limited to, a hydraulic jack or a load cell. The at least one load-applying mechanism 5 is removably mounted between the load-bearing plate 4 and the front load shelf 3. With reference to FIG. 6 and once the at least one load-applying mechanism 5 is finished applying a load to the failing load-bearing source, the at least one load-applying mechanism can be removed. The arrangement between the at least one load-applying mechanism 5, the front load shelf 3, and the load-bearing plate 4 allows the load from the failing load bearing source to be transferred to the present invention. In more detail, this allows the present invention to increase the structure life of the failing load-bearing source.

Figure 2:
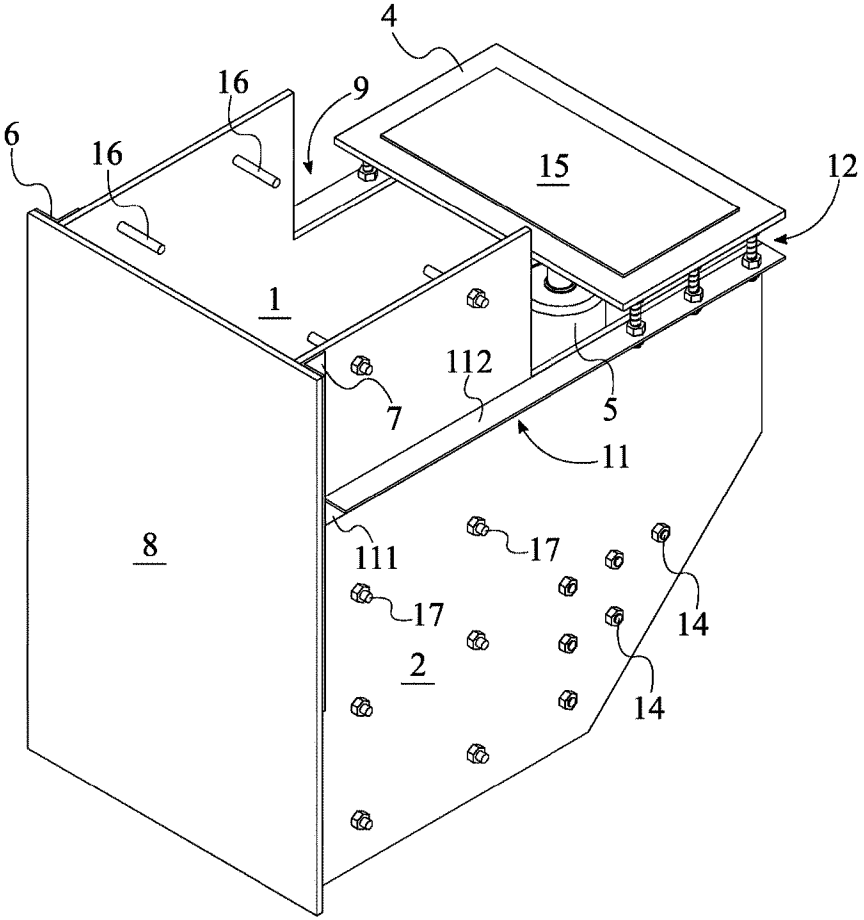
FIG. 2 is a rear perspective view of the present invention.

With reference to FIGS. 1 and 2, the present invention may further comprise a right-vertical mounting structure 6 and a left-vertical mounting structure 7. The right-vertical mounting structure 6 and the left-vertical mounting structure 7 are positioned offset from the front load-shelf. The right-vertical mounting structure 6 is connected onto the first side plate 1. The right-vertical mounting structure 6 can be connected onto the first side plate 1 by any means such as, but not limited to, fasteners or by being welded to the first side plate 1. The arrangement of the right-vertical mounting structure 6 allows the first side plate 1 to be mounted to the failing load-bearing source. Similarly, the left-vertical mounting structure 7 is connected onto the second side plate 2. The left-vertical mounting structure 7 can be connected onto the second side plate 2 by any means such as, but not limited to, fasteners or by being welded to the second side plate 2. The arrangement of the left-vertical mounting structure 7 allows the second side plate 2 to be mounted to the failing load-bearing source. In situations that involve failing load-bearing sources with columns, the present invention may further comprise a back plate 8 to provide more stability between the present invention and the fail load-bearing source. The back plate 8 is connected in between the right-vertical mounting structure 6 and the left-vertical mounting structure 7. The arrangement of the back plate 8 allows the present invention to be mounted to the failing load-bearing source.

Figure 4:
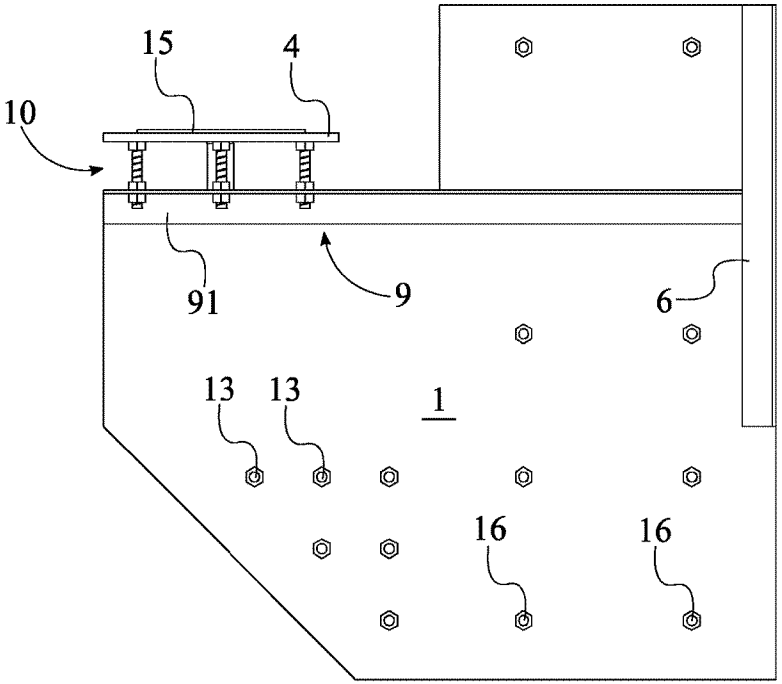
FIG. 4 is a right-side view of the present invention.
Figure 5:
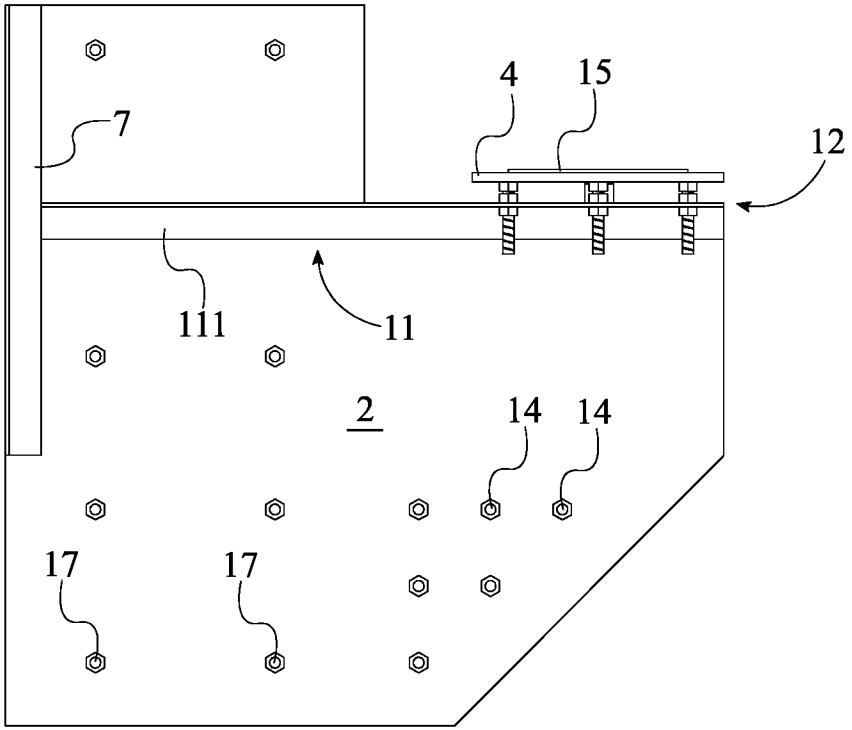
FIG. 5 is a left-side view of the present invention displaying the load-bearing plate in a lowered position.

With reference to FIG. 1, the present invention may further comprise a right-horizontal angle 9 and a plurality of right length-adjustable struts 10. The right-horizontal angle 9 provides a connection between the load-bearing plate 4 and the first side plate 1. The right-horizontal angle 9 comprises a first leg 91 and a second leg 92. The first leg 91 of the right-horizontal angle 9 is connected parallel onto the first side plate 1. The first leg 91 of the right-horizontal angle 9 can be connected onto the first side plate 1 by any means such as, but not limited to, fasteners or by being welded to the first side plate 1. The second leg 92 of the right-horizontal angle 9 is positioned perpendicular to the first side plate 1 and is positioned parallel and offset to the load-bearing plate 4. The second leg 92 of the right-horizontal angle 9 can be connected on the load-bearing plate 4 by any means such as, but not limited to, fasteners or by being welded to the load-bearing plate 4. With reference to FIGS. 4 and 5, the load-bearing plate 4 is operatively coupled to the second leg 92 of the right-horizontal angle 9 by the plurality of right length-adjustable struts 10, wherein the plurality of right length-adjustable struts 10 is used to adjust an offset distance between the second leg 92 and the load-bearing plate 4. In the preferred embodiment of the present invention, the plurality of right length-adjustable struts 10 may include least two threaded rods, a base nut, a load-locking nut, and a top nut as an assembly to adjust an offset distance between the second leg 92 and the load-bearing plate 4.

Similarly, and with reference to FIG. 2, the present invention may further comprise a left-horizontal angle 11 and a plurality of left length-adjustable struts 12. The left-horizontal angle 11 provides a connection between the load-bearing plate 4 and the second side plate 2. The left-horizontal angle 11 comprises a first leg 111 and a second leg 112. The first leg 111 of the left-horizontal angle 11 is connected parallel onto the second side plate 2. The first leg 111 of the left-horizontal angle 11 can be connected onto the second side plate 2 by any means such as, but not limited to, fasteners or by being welded to the second side plate 2. The second leg 112 of the left-horizontal angle 11 is positioned perpendicular to the second side plate 2 and is positioned parallel and offset to the load-bearing plate 4. The second leg 112 of the left-horizontal angle 11 can be connected on the load-bearing plate 4 by any means such as, but not limited to, fasteners or by being welded to the load-bearing plate 4. With reference to FIGS. 4 and 5, the load-bearing plate 4 is operatively coupled to the second leg 112 of the left-horizontal angle 11 by the plurality of left length-adjustable struts 12, wherein the plurality of left length-adjustable struts 12 is used to adjust an offset distance between the second leg 112 and the load-bearing plate 4. In the preferred embodiment of the present invention, the plurality of left length-adjustable struts 12 may include least two threaded rods, a base nut, a load-locking nut, and a top nut as an assembly to adjust an offset distance between the second leg 112 and the load-bearing plate 4.

Figure 3:
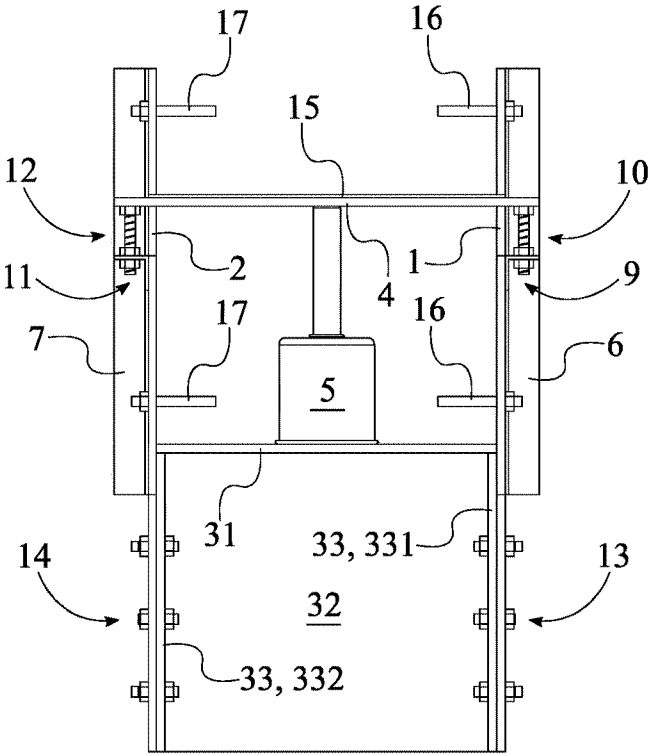
FIG. 3 is a front view of the present invention.

With reference to FIG. 3, the front load shelf 3 may comprise a first load plate 31, a second load plate 32, and a plurality of gusset plates 33. The first load plate 31 and the second load plate 32 form the structural shape of the front load shelf 3. The first load plate 31 and the second load plate 32 are adjacently and perpendicularly connected to each other. The plurality of gusset plates 33 provides stability to the front load shelf 3 and acts as a set of counterforts between the first side plate 1 and the second side plate 2. The plurality of gusset plates 33 is distributed along the front load shelf 3. The plurality of gusset plates 33 is connected in between the first load plate 31 and the second load plate 32. The arrangement of the plurality of gusset plates 33 provides rigidity to the front load shelf 3.

With reference to FIGS. 3 through 5, the present invention may further comprise a plurality of first fasteners 13 and a plurality of second fasteners 14. The plurality of gusset plates 33 comprises a first outer gusset plate 331 and a second outer gusset plate 332. The first outer gusset plate 331 is attached onto the first side plate 1 by the plurality of first fasteners 13. The arrangement of the first outer gusset plate 331 and plurality of first fasteners 13 allows the front load shelf 3 to be connected to the first side plate 1. Similarly, the second outer gusset plate 332 is attached onto the second side plate 2 by the plurality of second fasteners 14. The arrangement of the second outer gusset plate 332 and plurality of second fasteners 14 allows the front load shelf 3 to be connected to the second side plate 2.

With reference to FIG. 1, the present invention further comprises a friction-reducing brace 15. The friction-reducing brace 15 is connected onto the load-bearing plate 4, opposite to the at least one load-applying mechanism 5 in order to reduce friction between the failing load bearing source and the load-bearing plate 4 and allow ease of movement. The friction-reducing brace 15 may be any friction-reducing means such as, but not limited to, low friction bearing pad or a linear roller bearing assembly.

With reference to FIG. 4, the present invention may further comprise a plurality of first anchors 16. The plurality of first anchors 16 allows the first side plate 1 to be connected to the failing load-bearing source. The plurality of first anchors 16 is positioned adjacent to the front load shelf 3 and is distributed across the first side plate 1. Each of the plurality of first anchors 16 is fixed onto the first side plate 1. The arrangement of the plurality of first anchors 16 allows the first side plate 1 to be properly secured to the failing load-bearing source by being traversed through the first side plate 1 and into the failing load-bearing source.

Similarly, and with reference to FIG. 5, the present invention may further comprise a plurality of second anchors 17. The plurality of second anchors 17 allows the second side plate 2 to be connected to the failing load-bearing source. The plurality of second anchors 17 is positioned adjacent to the front load shelf 3 and is distributed across the second side plate 2. Each of the plurality of second anchors 17 is fixed onto the second side plate 2. The arrangement of the plurality of second anchors 17 allows the second side plate 2 to be properly secured to the failing load-bearing source by being traversed through the second side plate 2 and into the failing load-bearing source.

Although the invention has been explained in relation to its preferred embodiment, it is to be understood that many other possible modifications and variations can be made without departing from the spirit and scope of the invention as hereinafter claimed.

What is claimed is:

1. A load conveyance apparatus comprising:

a first side plate;

a second side plate;

a front load shelf;

a load-bearing plate;

at least one load-applying mechanism;

the first side plate and the second side plate being positioned parallel and offset to each other;

the front load shelf being mounted in between the first side plate and the second side plate;

the load-bearing plate being mounted in between the first side plate and the second side plate;

the load-bearing plate and front load shelf being positioned offset from each other;

the at least one load-applying mechanism being removably mounted between the load bearing plate and the front load shelf;

a right-horizontal angle;

a plurality of right length-adjustable struts;

the right-horizontal angle comprising a first leg and a second leg;

the first leg being connected parallel onto the first side plate;

the second leg being positioned perpendicular to the first side plate;

the second leg being positioned parallel and offset to the load-bearing plate; and the load-bearing plate being operatively coupled to the second leg by the plurality of right length-adjustable struts, wherein the plurality of right length-adjustable struts is used to adjust an offset distance between the second leg and the load-bearing plate.

2. The load conveyance apparatus as claimed in claim 1 comprising:

a right-vertical mounting structure;

a left-vertical mounting structure;

the right-vertical mounting structure and the left-vertical mounting structure being positioned offset from the front load shelf;

the right-vertical mounting structure being connected onto the first side plate; and the left-vertical mounting structure being connected onto the second side plate.

3. The load conveyance apparatus as claimed in claim 2 comprising:

a back plate; and the back plate being connected in between the left-vertical mounting structure and the right-vertical mounting structure.

4. The load conveyance apparatus as claimed in claim 1 comprising:

a left-horizontal angle;

a plurality of left length-adjustable struts;

the left-horizontal angle comprising a first leg and a second leg;

the first leg being connected parallel onto the second side plate;

the second leg being positioned perpendicular to the second side plate;

the second leg being positioned parallel and offset to the load-bearing plate; and the load-bearing plate being operatively coupled to the second leg by the plurality of left length-adjustable struts, wherein the plurality of left length-adjustable struts is used to adjust an offset distance between the second leg and the load-bearing plate.

5. The load conveyance apparatus as claimed in claim 1 comprising:

the front load shelf comprising a first load plate and a second load plate; and the first load plate and the second load plate being adjacently and perpendicularly connected to each other.

6. The load conveyance apparatus as claimed in claim 5 comprising:

the front load shelf further comprising a plurality of gusset plates;

the plurality of gusset plates being distributed along the front load shelf; and the plurality of gusset plates being connected in between the first load plate and the second load plate.

7. The load conveyance apparatus as claimed in claim 6 comprising:

a plurality of first fasteners;

a plurality of second fasteners;

the plurality of gusset plates comprising a first outer gusset plate and a second outer gusset plate;

the first outer gusset plate being attached onto the first side plate by the plurality of first fasteners; and the second outer gusset plate being attached onto the second side plate by the plurality of second fasteners.

8. The load conveyance apparatus as claimed in claim 1 comprising:

a friction-reducing brace; and the friction-reducing brace being connected onto the load-bearing plate, opposite to the at least one load-applying mechanism.

9. The load conveyance apparatus as claimed in claim 1 comprising:

a plurality of first anchors;

the plurality of first anchors being positioned adjacent to the front load shelf;

the plurality of first anchors being distributed across the first side plate; and each of the plurality of first anchors being fixed onto the first side plate.

10. The load conveyance apparatus as claimed in claim 1 comprising:

a plurality of second anchors;

the plurality of second anchors being positioned adjacent to the front load shelf;

the plurality of second anchors being distributed across the second side plate; and each of the plurality of second anchors being fixed onto the second side plate.

11. A load conveyance apparatus comprising:

a first side plate;

a second side plate;

a front load shelf;

a load-bearing plate;

at least one load-applying mechanism;

a right-vertical mounting structure;

a left-vertical mounting structure;

a friction-reducing brace;

the first side plate and the second side plate being positioned parallel and offset to each other;

the front load shelf being mounted in between the first side plate and the second side plate;

the load-bearing plate being mounted in between the first side plate and the second side plate;

the load-bearing plate and front load shelf being positioned offset from each other;

the at least one load-applying mechanism being removably mounted between the load bearing plate and the front load shelf;

the right-vertical mounting structure and the left-vertical mounting structure being positioned offset from the front load shelf;

the right-vertical mounting structure being connected onto the first side plate;

the left-vertical mounting structure being connected onto the second side plate;

the friction-reducing brace being connected onto the load-bearing plate, opposite to the at least one load-applying mechanism;

a right-horizontal angle;

a plurality of right length-adjustable struts;

the right-horizontal angle comprising a first leg and a second leg;

the first leg being connected parallel onto the first side plate;

the second leg being positioned perpendicular to the first side plate;

the second leg being positioned parallel and offset to the load-bearing plate; and the load-bearing plate being operatively coupled to the second leg by the plurality of right length-adjustable struts, wherein the plurality of right length-adjustable struts is used to adjust an offset distance between the second leg and the load-bearing plate.

12. The load conveyance apparatus as claimed in claim 11 comprising:

a back plate; and the back plate being connected in between the left-vertical mounting structure and the right-vertical mounting structure.

13. The load conveyance apparatus as claimed in claim 11 comprising:

a left-horizontal angle;

a plurality of left length-adjustable struts;

the left-horizontal angle comprising a first leg and a second leg;

the first leg being connected parallel onto the second side plate;

the second leg being positioned perpendicular to the second side plate;

the second leg being positioned parallel and offset to the load-bearing plate; and the load-bearing plate being operatively coupled to the second leg by the plurality of left length-adjustable struts, wherein the plurality of left length-adjustable struts is used to adjust an offset distance between the second leg and the load-bearing plate.

14. The load conveyance apparatus as claimed in claim 11 comprising:

the front load shelf comprising a first load plate and a second load plate; and the first load plate and the second load plate being adjacently and perpendicularly connected to each other.

15. The load conveyance apparatus as claimed in claim 14 comprising:

the front load shelf further comprising a plurality of gusset plates;

the plurality of gusset plates being distributed along the front load shelf; and the plurality of gusset plates being connected in between the first load plate and the second load plate.

16. The load conveyance apparatus as claimed in claim 15 comprising:

a plurality of first fasteners;

a plurality of second fasteners;

the plurality of gusset plates comprising a first outer gusset plate and a second outer gusset plate;

the first outer gusset plate being attached onto the first side plate by the plurality of first fasteners; and the second outer gusset plate being attached onto the second side plate by the plurality of second fasteners.

17. The load conveyance apparatus as claimed in claim 11 comprising:

a plurality of first anchors;

the plurality of first anchors being positioned adjacent to the front load shelf;

the plurality of first anchors being distributed across the first side plate; and each of the plurality of first anchors being fixed onto the first side plate.

18. The load conveyance apparatus as claimed in claim 11 comprising:

a plurality of second anchors;

the plurality of second anchors being positioned adjacent to the front load shelf;

the plurality of second anchors being distributed across the second side plate; and each of the plurality of second anchors being fixed onto the second side plate.

* * * * *